US010730685B2

(12) United States Patent
White et al.

(10) Patent No.: US 10,730,685 B2
(45) Date of Patent: Aug. 4, 2020

(54) SYSTEM TO HOLD MULTIPLE BEVERAGE CONTAINERS

(71) Applicant: Lightbulb Innovation, LLC, Lucas, TX (US)

(72) Inventors: Russell W. White, Austin, TX (US); Shawn A. Roberts, Allen, TX (US); Laura J. Roberts, Allen, TX (US)

(73) Assignee: Lightbulb Innovation, LLC, Lucas, TX (US)

( * ) Notice: Subject to any disclaimer, the term of this patent is extended or adjusted under 35 U.S.C. 154(b) by 115 days.

(21) Appl. No.: 16/115,871

(22) Filed: Aug. 29, 2018

(65) Prior Publication Data

US 2019/0084752 A1 Mar. 21, 2019

Related U.S. Application Data

(60) Provisional application No. 62/560,295, filed on Sep. 19, 2017.

(51) Int. Cl.
*B65D 81/38* (2006.01)
*B65D 25/24* (2006.01)
(Continued)

(52) U.S. Cl.
CPC ..... *B65D 81/3897* (2013.01); *B65D 25/14* (2013.01); *B65D 25/24* (2013.01);
(Continued)

(58) Field of Classification Search
CPC ..... B65D 81/3897; B65D 81/3888; B65D 81/3876; B65D 81/261; B65D 88/22;
(Continued)

(56) References Cited

U.S. PATENT DOCUMENTS 6,131,732 A 10/2000 Schneider
6,814,252 B2 11/2004 Murakami
(Continued)

FOREIGN PATENT DOCUMENTS

DE 12005035674 7/2006
DE 102005035676 7/2006
WO WO-9924327 A1 * 5/1999 ..... B65D 90/06

OTHER PUBLICATIONS

English Language Translation of German Publication No. 102005035676, 16 pages total.
(Continued)

*Primary Examiner* — Robert J Hicks
(74) *Attorney, Agent, or Firm* — Trop, Pruner & Hu, P.C.

(57) ABSTRACT

A system for holding multiple beverage containers may include a cooler or carrier with toting handles, closing tabs, and base. The base may be formed from a molded plastic, rubber or synthetic rubber material. The base may also include feet that hold the base a sufficient height from the ground. The base may have a generally conic tapering drain floor that makes up its top surface. The tapering drain floor may make draining the carrier easier by directing water toward a drain hole located in the base. Extending up from the base may be a multi-layer soft-sided wall where different layers perform different desired functions. For example, an inside layer closest to the internal cavity may be a waterproof layer, a middle layer may be an insulating layer, and an external layer may be a decorative layer.

20 Claims, 7 Drawing Sheets

(51) Int. Cl.

| | |
|---|---|
| ***B65D 25/28*** | (2006.01) |
| ***B65D 25/14*** | (2006.01) |
| ***B65D 25/38*** | (2006.01) |
| ***F25D 3/08*** | (2006.01) |
| ***B65D 88/16*** | (2006.01) |
| *F25D 21/14* | (2006.01) |

(52) U.S. Cl.

CPC ..... *B65D 25/2864* (2013.01); *B65D 25/38* (2013.01); *B65D 88/16* (2013.01); *F25D 3/08* (2013.01); *F25D 21/14* (2013.01); *F25D 2303/081* (2013.01); *F25D 2331/801* (2013.01); *F25D 2331/803* (2013.01); *F25D 2331/805* (2013.01); *F25D 2331/809* (2013.01)

(58) Field of Classification Search

CPC ..... B65D 88/16; B65D 90/24; B65D 25/14; B65D 25/24; B65D 25/2864; B65D 25/38; B65D 25/22; F16N 31/004; F25D 3/08; F25D 21/14

USPC ..... 220/915.2, 915.1, 592.03, 592.26, 592.2, 220/571.1, 571, 630, 628, 739, 737, 904; 62/457.7, 457.5, 457.4, 457.3, 457.2, 62/457.1

See application file for complete search history.

(56) References Cited

U.S. PATENT DOCUMENTS

| | | | |
|---|---|---|---|
| 10,173,827 | B1 | 1/2019 | Foote, Jr. |
| 2002/0096916 | A1 | 7/2002 | Combs |
| 2004/0025530 | A1 | 2/2004 | Perrins |
| 2005/0082455 | A1 | 4/2005 | Jones |
| 2017/0055665 | A1 | 3/2017 | Lanzisera |
| 2017/0232355 | A1 | 8/2017 | Healy |
| 2018/0199742 | A1 | 7/2018 | Rogers |
| 2019/0077290 | A1 | 3/2019 | White et al. |

OTHER PUBLICATIONS

U.S. Patent and Trademark Office, Non-Final Office Action dated Oct. 18, 2019 in U.S. Appl. No. 16/115,827, 21 pages total.

U.S. Patent and Trademark Office, Restriction Requirement dated Aug. 7, 2019 in U.S. Appl. No. 16/115,827, along with Election filed Oct. 2, 2019, 12 pages total.

* cited by examiner

SYSTEM TO HOLD MULTIPLE BEVERAGE CONTAINERS

This application claims priority to U.S. Provisional Patent Application No. 62/560,295, filed on Sep. 19, 2017, in the names of Russell W. White, Shawn A. Roberts, and Laura J. Roberts, entitled "System To Hold Multiple Beverage Containers," the disclosure of which is hereby incorporated by reference.

FIELD OF THE DISCLOSURE

The present disclosure relates to beverage containers and, more specifically, to a system to hold multiple beverage containers.

BACKGROUND

Beverage containers come in many different sizes and shapes. Beverages may be served in bottles, in cans, in plastic cups, in glasses, and in insulated containers just to name a few. Many of these containers are designed to be hand-held, but there are circumstances that make holding multiple containers at once difficult or dangerous. Moreover, there are times when it is desirable to keep a collection of beverage containers cold or hot for extended periods of time. Aquatic and outdoor activities are frequently enjoyed in areas that do not lend themselves to the use of a refrigerator or an oven, and it is common for a person to want a cold or warm beverage while they are enjoying these types of activities. As such, individuals often need a cooler or other device capable of holding multiple containers and keeping those containers at or near a desired temperature.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
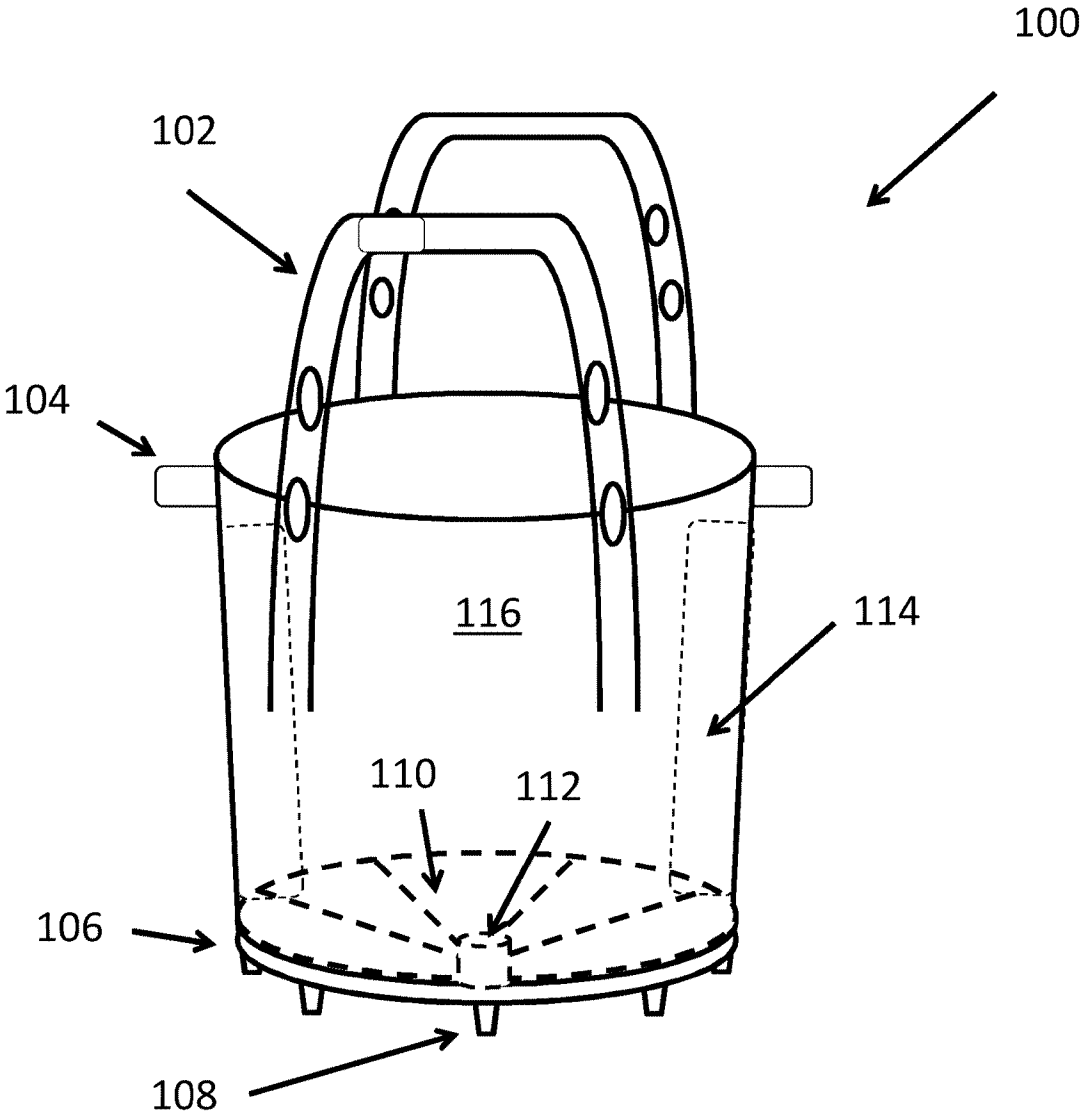
FIG. 1 depicts a general system for holding multiple beverage containers that incorporates teachings of the present disclosure.

The following discussion is intended to provide one skilled in the art with various teachings that can be combined and/or separated to create useful and/or desirable products. The teachings can be employed in a variety of settings. For example, a designer could use these teachings to create an automobile-oriented, boat-oriented, and/or other vehicle-oriented product. Additionally, a designer may want to employ many of these teachings to produce an attractive picnic or beach going type product.

While there are many opportunities for designers to use the teachings disclosed herein, the majority of this detailed description section will focus on embodiments designed for a soft-sided cooler that typically utilizes ice cubes or other frozen objects to facilitate keeping various beverage containers at a desired and chilled temperature. The decision to focus on this implementation is not intended to limit the scope of the teachings, but rather to facilitate a clear presentation of the teachings.

Devices that maintain multiple beverage containers at or near some desired temperature tend to be of two types: hard-sided insulated containers or soft-sided insulated containers. Hard-sided portable insulated containers tend to be made of molded plastic, with an inner layer, or wall, and an outer layer or wall, with an insulation space between. Hard-sided containers are rigid and frequently very heavy. They also tend to be bulky and difficult to carry. A soft-sided cooler, by contrast, can rely on external wall structure that is not substantially rigid. The wall structure may incorporate a multi-layer design that includes an outside layer of webbing or fabric, an inside layer of waterproof webbing or fabric, and a flexible insulation layer positioned between the inner and outer layers. A designer will recognize that layers may be added or removed to meet certain objectives. In some embodiments, a soft-sided cooler may include a rigid or semi-rigid element to give the cooler some stability and to help the cooler maintain a given shape or protect items inside the cooler.

Throughout this description, containers may be referred to as "coolers." Similarly, the portion of the container that opens and closes to facilitate accessing multiple beverage containers stored within the container will typically be referred to as the top of the container. As such, the base panel will typically be referred to as the bottom. The multiple layers that may make up the side walls may be a sandwich of various components. For example, a middle insulating layer may include a flexible or resilient layer of a relatively soft and flexible foam. As noted above, sidewall elements of the cooler may have insulating properties such that heat transfer across the panel is limited. An example of a potential panel construction is an internal core of foam such as closed cell polyurethane foam. The insulating foam is in turn received between a protective, potentially waterproof layer provided on the interior of the container and a potentially decorative layer of polymer sheeting, such as nylon sheeting. As explained in more detail below, a cooler incorporating teachings disclosed herein may include a convertible feature wherein a user can change an exterior panel of the cooler to give it a different look on different occasions or simply to replace a stained or dated exterior shell. In order to maintain the soft-sided characteristics of some embodiments, at least the sidewalls may be formed to be pliable.

To be clear, potential insulated coolers incorporating the teachings of this disclosure may be used to carry cold items such as soda, beer, sandwiches, ice cream, meat, and so on. Alternatively, the insulated coolers can be used to transport hot items such as casseroles, lasagna, vegetables, etc.

With that said and as mentioned above, FIG. 1 depicts a general system for holding multiple beverage containers that incorporates teachings of the present disclosure. Carrier 100 includes toting handles 102, closing tabs 104, and base 106. As depicted, base 106 may have a generally elliptical shape when viewed from above. In addition, base 106 may be formed from a molded plastic, rubber or synthetic rubber material. A designer may choose other materials to meet design objectives. As shown, base 106 includes feet 108, which may be formed as an integral part of base 106. For example, if base 106 is a molded part, feet 108 may be included in the mold. A more detailed description of what a base like base 106 may look like is included in connection with FIG. 4A.

As depicted in FIG. 1, base 106 includes a generally conic tapering drain floor 110 that makes up its top surface (as shown, feet 108 are on the bottom surface). Tapering drain floor 110 may facilitate the draining of carrier 100 by directing water (which may have resulted from melting ice) toward drain 112. As shown, drain 112 defines a hole that passes through the thickness of base 106 and allows water to escape an internal cavity of container 100 that is at least partially formed by sidewalls 116, which may be formed as a multi-layer wall where different layers perform different desired functions. For example, an inside layer closest to the internal cavity may be a waterproof layer, a middle layer may be an insulating layer, and an external layer may be a decorative layer.

As shown, beverage sleeves 114 are shown as being inside container 100. Depending on design concerns, beverage sleeves 114 may be formed from a stretch fabric, which may be a synthetic fabric that stretches. The stretch fabric may be a multi-way stretch fabric such as 2-way stretch or 4-way stretch. An exemplary 2-way stretch fabric may stretch in one direction, such as from selvedge to selvedge (but can be in other directions depending on the knit). An exemplary 4-way stretch fabric, such as spandex, may stretch in both directions, crosswise and lengthwise. A given stretch fabric may include fibers of neoprene. Example stretch fabrics could include elastomerics like spandex or Lycra. With that said, a designer could choose whichever stretch fabric he or she wanted to accomplish a given deign goal. A deeper understanding of the potential benefits of beverage sleeves 114 may be understood by referencing the next figure.

Figure 2:
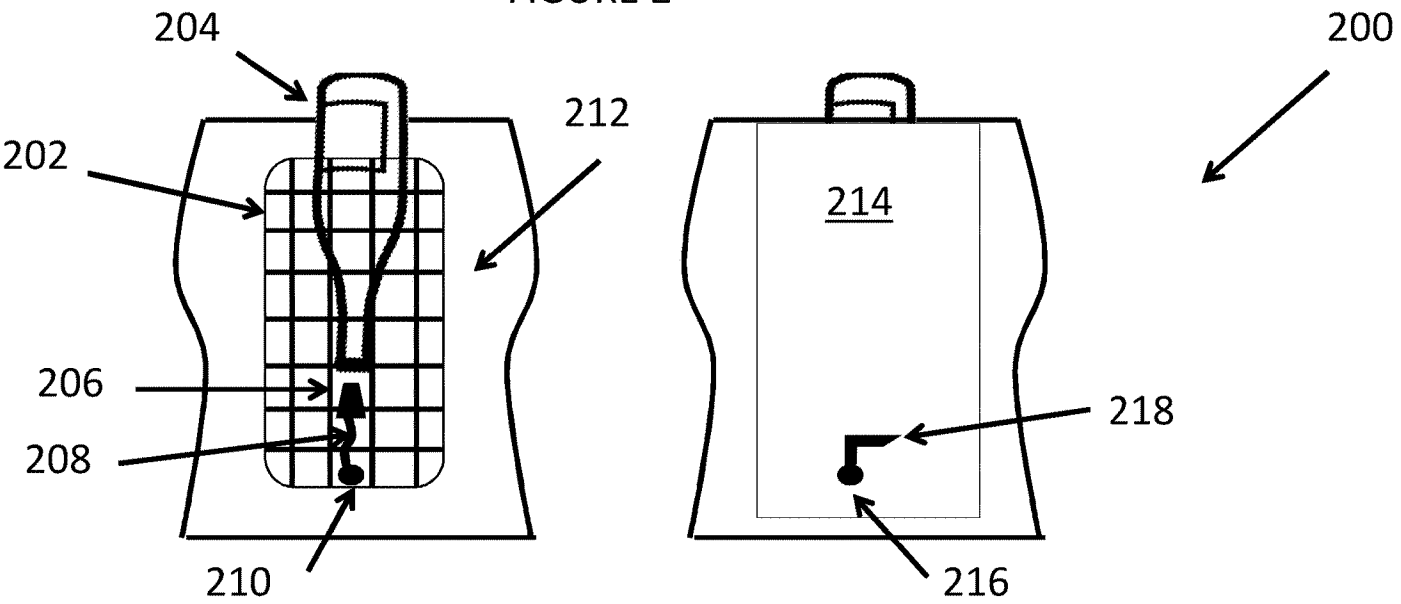
FIG. 2 illustrates an element of a given embodiment of a device for holding multiple beverage containers that incorporates teachings of the present disclosure.

As mentioned above, FIGS. 2 and 3 illustrate elements of a given embodiment of a device for holding multiple beverage containers that incorporates teachings of the present disclosure. As depicted, system 200 provides a beverage sleeve designed to maintain a bottled beverage 204 within a beverage sleeve 202. Sleeve 202 is depicted as having a grid pattern. A designer may choose any number of patterns. In some embodiments, sleeve 202 may not include holes larger enough for even small ice cubes to pass from one side to the other of sleeve 202. In such an embodiment, ice placed within a container like container 100 will not easily makes its way inside a sleeve like sleeve 202. This may make it easier for a user to remove and then replace bottled beverage 204 from sleeve 202.

As depicted, sleeve 202 is located inside and connected to inside wall surface 212. Also on the inside is plug 206 and tube 208. In practice, a user may remove the lid from bottled beverage 204 and insert plug 206 into the bottle's open end. The beverage inside may then be able to pass through the open end, through a hole within insert plug 206 and into tube 208, which is connected to plug 206. Tube 208 may be routed to and/or through port 210, which may allow the beverage inside the bottle to makes its way from the inside of a container to a dispensing port 216, which may located on or near an outside wall surface 214. Depending upon designer concerns, dispensing port 216 may be controlled by any number of devices. As shown, dispensing port 216 includes a lever-operated stopcock 218. One of skill in the art may choose other mechanisms such as a push button, etc. As shown, a container like container 100 that incorporates the elements of system 200 may allow a user to open a bottle of wine, connect the bottle to a dispensing mechanism (the one depicted uses gravity, but various pressuring mechanisms and/or other methods could be used), place the bottle inside the cooler, close the cooler, and enjoy the wine without having to reopen the cooler.

Figure 3:
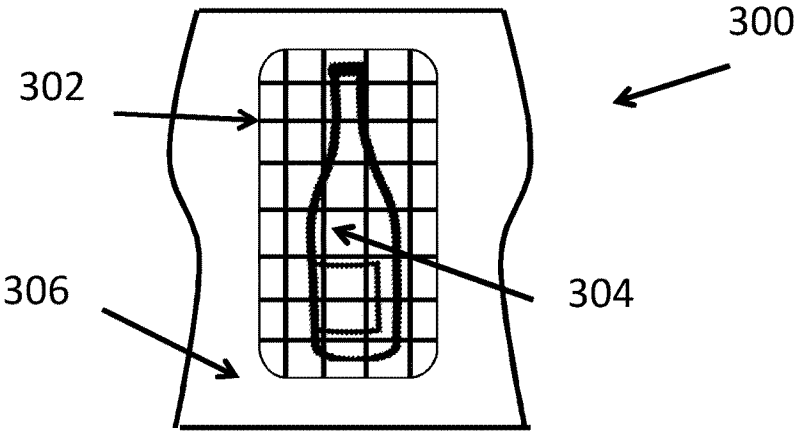
FIG. 3 illustrates an element of a given embodiment of a device for holding multiple beverage containers that incorporates teachings of the present disclosure.

FIG. 3 depicts a system 300 that removes the dispensing mechanism. Some users may prefer to simply place a bottle 304 within a sleeve 302 located along inside wall surface 306. Such an embodiment keeps bottle 304 cool and makes its easy to remove and replace bottle 304 within a container like container 100. As depicted in the first three figures, a container like container 100 may be proportioned such that a bottled beverage can be placed within a sleeve while still allowing the container to be closed. This helps keep the bottle upright while it is within the cooler. The sleeve also allows a user to benefit from the ice within a cooler as it keeps the bottle cool without having to "fight" the ice to fit the bottle back inside the cooler.

Figure 4A:
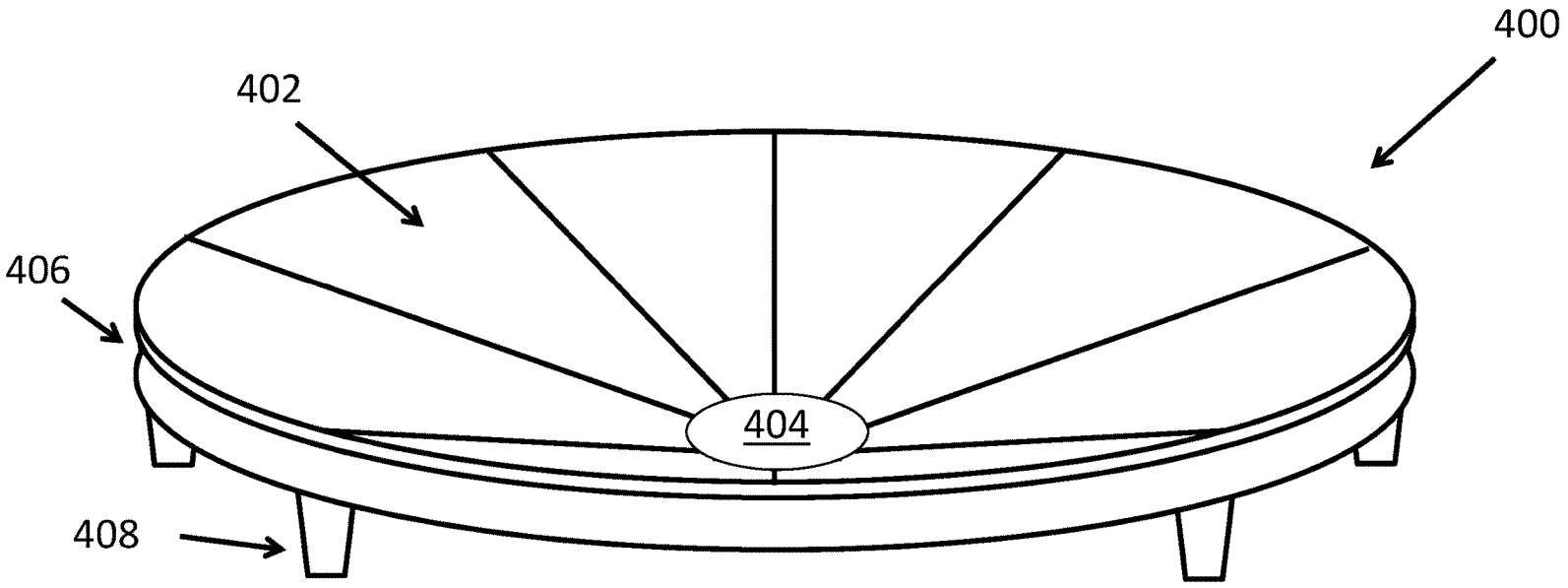
FIGS. 4A and 4B illustrate a base option for a given embodiment of a device for holding multiple beverage containers that incorporates teachings of the present disclosure.

As mentioned above, FIGS. 4A and 4B, and FIG. 5 illustrate base options for a given embodiment of a device for holding multiple beverage containers that incorporates teachings of the present disclosure. Base 400 is largely depicted as a single piece of material. A designer could utilize this technique or combine several different pieces to meet his or her objectives. As mentioned above, a designer could also choose from various materials to form base 400. It could be a rubber, a synthetic rubber, a plastic, a metal, a composite, and/or various other options. It could be injection molded, molded in other ways, 3D printed, formed, etc. As shown in FIG. 4A (a perspective view looking at the top of base 400), base 400 has a symmetrical draining geometry 402 directing water to a centrally located drain 404. A designed may also choose an asymmetrical geometry.

As shown, base 400 has a generally elliptical shape. In practice, the size, shape, and weight of base 400 may be chosen to facilitate a container's ability to maintain itself in an upright position. Base 400 is also depicted as having multiple feet 408 and a couple ridge 406. In practice, base 400 may be formed of a material that is different that the multi-layer sidewalls of a cooler utilizing base 400. Moreover, base 400 may be formed in separately and in a different location. It may be brought together with the sidewalls during a manufacturing process. As such, ridge 406 may facilitate a mating of base 400 with a sidewall of a designer's choosing.

Figure 4B:
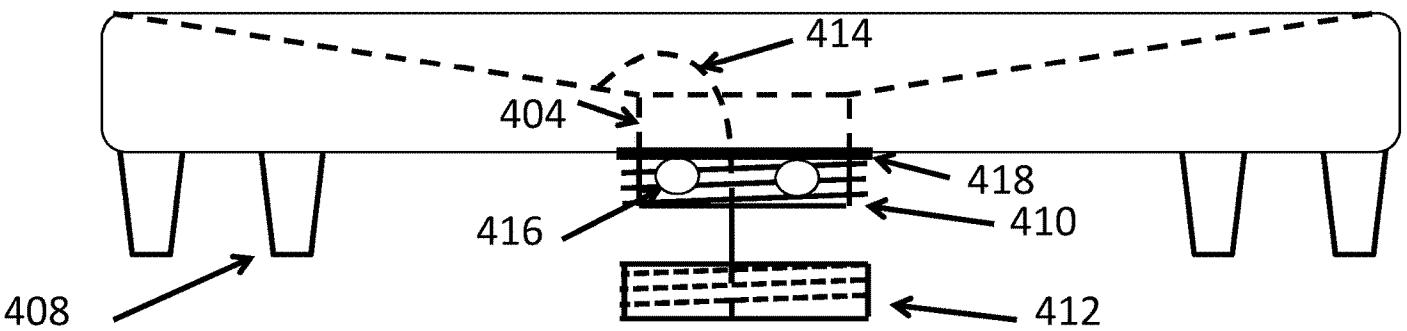
Figure 5:
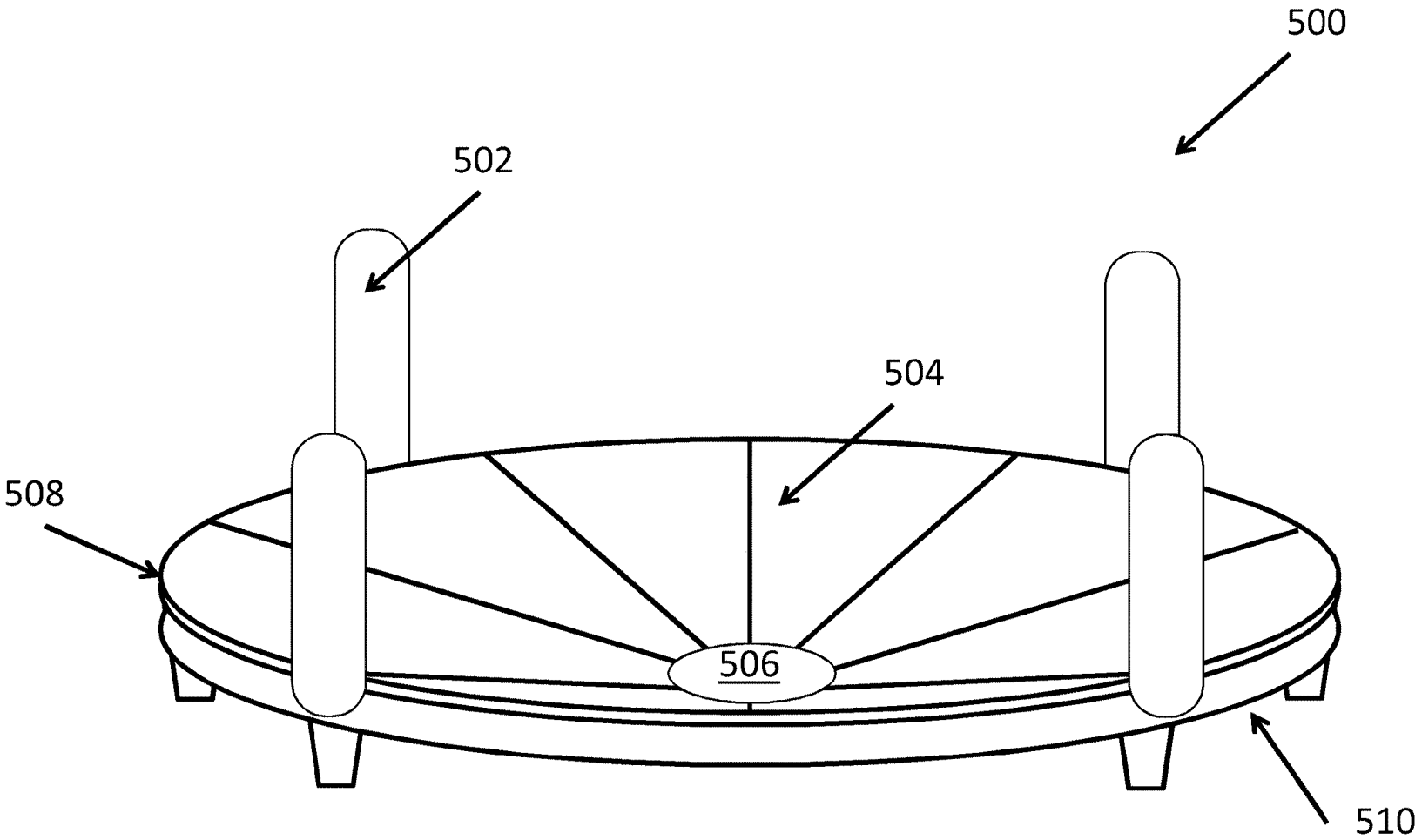
FIG. 5 illustrates a base option for a given embodiment of a device for holding multiple beverage containers that incorporates teachings of the present disclosure.

FIG. 4B presents a side view of base 400, which indicates a thickness to the body of the base. As shown in this embodiment, feet 408 are sufficient long to allow the body of base 400 to be elevated from a surface upon which feet 408 rest. Drain 404 extends through base 400 and an extended portion of drain 404 includes a threaded surface 410. As shown, the male threads of threaded surface 410 are designed to interact with the threaded surface located within cap 412, which is tethered to base 400 via securing tether 414. A designer may choose any number of techniques (or no technique at all) to ensure that cap 412 is not easily lost. The tethering option depicted is just one option. As shown, threaded surface 410 includes drain ports 416. In some embodiments, a designer may design the system in a manner that allows a user to unscrew cap 412 without allowing for cap 412's complete disconnection from base 400. In such an embodiment, ports 416 may allow water to escape from within the cooler without risking the loss of cap 412. As shown, ring 418 is included. Ring 418 may be, for example, a rubber O-ring that helps ensure a waterproof seal when cap 412 is secured to base 400 via threaded surface 410.

As mentioned above, FIG. 5 illustrates a base option, base 500, for a given embodiment of a device for holding multiple beverage containers that incorporates teachings of the present disclosure. As shown, base 500 includes four stiffening tabs 502. In practice, tabs 502 may assist in keeping a soft-sided cooler in an upright position by acting in a skeleton like manner. Providing some vertical structure, tabs 502 may help keep a cooler from tipping over. Base 500 also includes a draining geometry 504. As shown, geometry 504 may create a generally symmetrical and conical void directed toward drain 506. As mentioned above, drain 506 may be located nearer a given edge in some designs as opposed to in the center. Similarly, a base may take on a square, rectangular, triangular, elliptical, circular, etc. shape. Base 500 also includes an interior material coupling ridge 508 and an exterior material coupling ridge 510. As mentioned above, soft-sided sidewalls may be formed with a multi-layer offering. An interior facing material may be a waterproof material. A middle layer may be an insulating material. In some embodiments, a third layer may be used to encapsulate the insulating layer between the interior layer and the third layer. A designer may want such a three layer "bag" to be coupled to the base along coupling ridge 508, which could also be located closer to drain 506. The methodology for connecting the "bag" to the base could take several forms. It could be a near permanent connection or an easily removed connection. It could include adhesives, heat treatments, zipping solutions, etc.

In such a system, the designer may want to offer users an interchangeable exterior layer that could be, for example, more decorative. In such a system, the designer may want the exterior layer to couple to the base at ridge 510. For example, an exterior layer may utilize a zipper to connect to base 500. The exterior could also use other connection techniques. For example, the exterior layer may include straps that connect underneath base 500. However connected, an interchangeable exterior layer may allow users a great deal of flexibility in changing the appearance and/or replacing an existing worn or tattered exterior shell. As shown, tabs 502 may be located between an interior multi-layer "bag" and an exterior layer.

Figure 6:
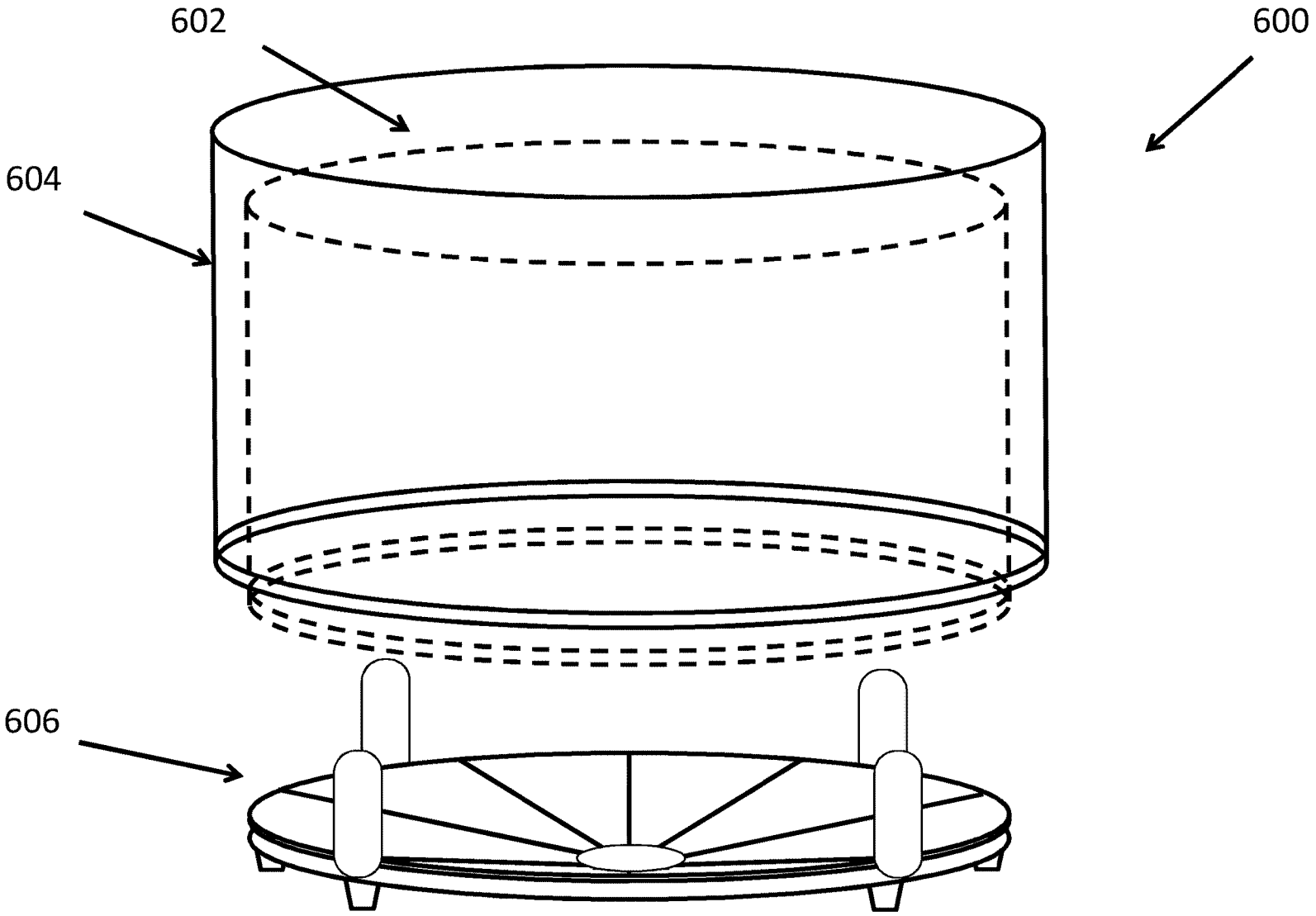
FIG. 6 illustrates an exploded view for a given embodiment of a device for holding multiple beverage containers that incorporates teachings of the present disclosure.

FIG. 6 illustrates an exploded view for a given embodiment of a device for holding multiple beverage containers that incorporates teachings of the present disclosure. System 600 an interior material or multi-layer material 602, and exterior material 604, and a base 606. In practice the three pieces may be manufactured separately from one another and then assembled into a complete system 600.

Figures 7A, 7B, 7C:
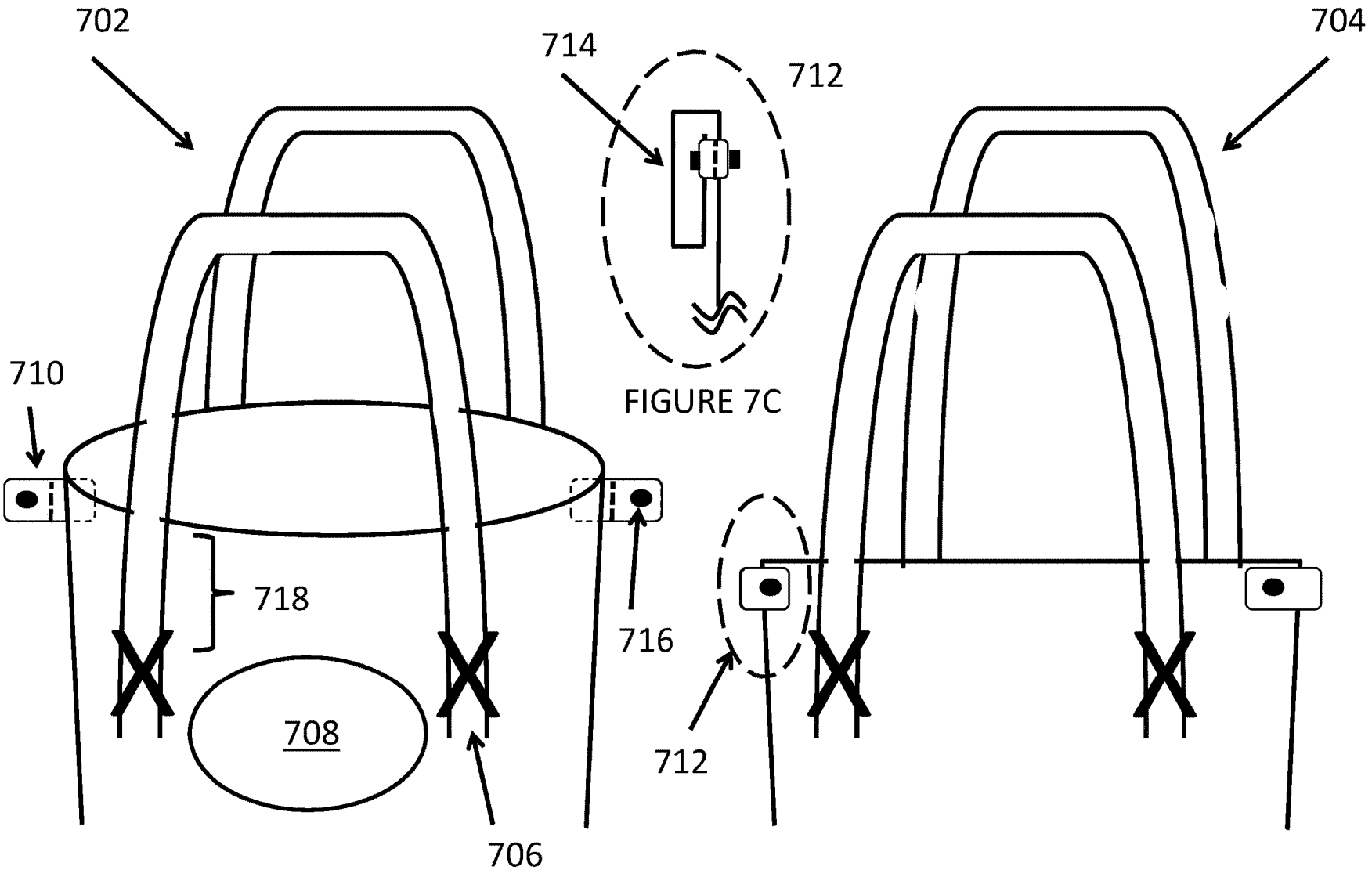
FIGS. 7A-7C illustrate open and closed views for a given embodiment of a device for holding multiple beverage containers that incorporates teachings of the present disclosure.

FIGS. 7A-7C illustrate open and closed views, respectively, for a given embodiment of a device for holding multiple beverage containers that incorporates teachings of the present disclosure. As shown, carrier 702 is an open configuration allowing easy access to the interior void of the carrier. Carrier 704 presents a closed configuration of the container. As shown on carrier 702, handles are connected to an exterior surface using stitching 706. The location of stitching 706 relative to the top of opened container 702 may be chosen to leave sufficient distance 718 to allow a rolled or folded closing of carrier 702. Carrier 702 also includes a branding or monogramming surface 708 and magnetic tab closers 710.

As shown with carrier 702, magnetic tabs 710 are in an open position. The tabs are in a closed position 712 in connection with carrier 704 and FIG. 7C. As shown more clearly in FIG. 7C, container sidewall 714 is folded over itself twice and magnetic tabs 710 are in a closed position. In use, magnet 716 is attracted to another magnet on the other end of tab 710. When the top of the container is folded over itself, magnetic tab 710 may be folded in half to bring magnet 716 into close proximity with the magnet on the other end of tab 710. In the folded or closed position, the two magnets hold tab 710 closed and assist in insulating the interior portion of the container.

Figure 8:
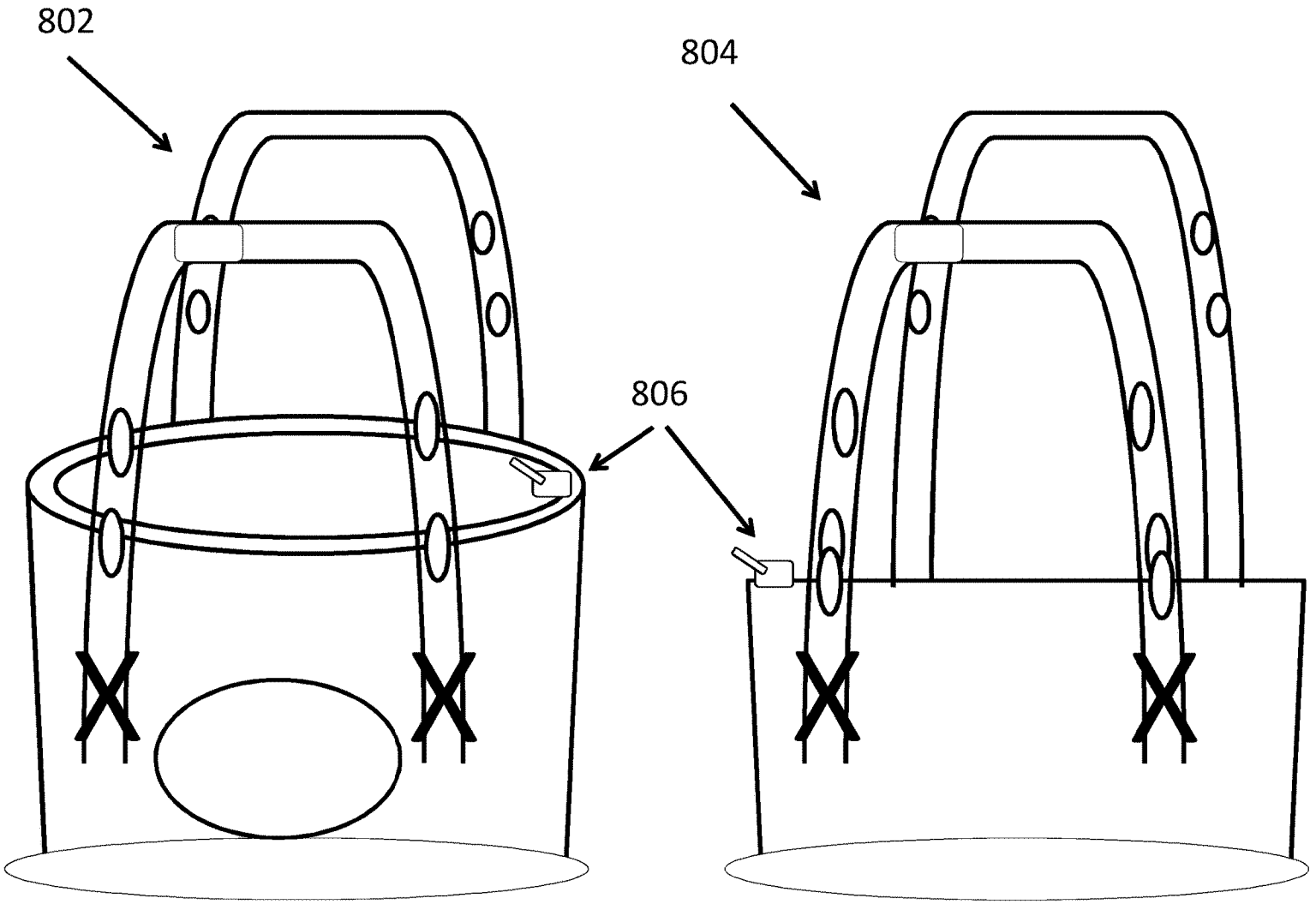
FIG. 8 illustrates an open and closed view for a given embodiment of a device for holding multiple beverage containers that incorporates teachings of the present disclosure.

FIG. 8 illustrates an open 802 and closed 804 view for a given embodiment of a device for holding multiple beverage containers that incorporates teachings of the present disclosure. In the embodiment of FIG. 8, the opening and closing mechanism 806 is a zipper or zip-lock type of locking mechanisms. A designer may choose whatever type of closing mechanism works for his or her design.

The benefits, advantages, solutions to problems, and any element(s) that may cause any benefit, advantage, or solution to occur or become more pronounced are not to be construed as a critical, required, or essential feature or element of the present invention. Accordingly, the present invention is not intended to be limited to the specific form set forth herein, but on the contrary, it is intended to cover such alternatives, modifications, and equivalents, as can be reasonably included within the spirit and scope of the invention as provided by the claims below.

While the present invention has been described with respect to a limited number of embodiments, those skilled in the art will appreciate numerous modifications and variations therefrom. It is intended that the appended claims should cover any such modifications and variations as fall within their true spirit and scope.

What is claimed is:

1. A system to hold a plurality of beverage containers, comprising:

a base having a body portion and a plurality of feet extending down from the body portion;

the plurality of feet formed of a non-marking and non-slipping material;

the body portion having a generally elliptical shape, a generally conical draining geometry, and a draining system at least partially forming a draining hole formed through the base to allow water resting on a top surface of the base to flow through the base;

the draining system including a cap configured to couple to the base in a manner that facilitates a loosening of the cap to allow water to drain through the draining hole and a tightening of the cap to restrict water from draining through the draining hole;

a soft-sided sidewall coupled to the base and formed to have an interior waterproof layer, a middle insulating layer, and an exterior layer;

a beverage sleeve located within an enclosure at least partially formed by the soft-sided sidewall, the beverage sleeve including a 4-way stretch fabric to facilitate holding a beverage container within the beverage sleeve;

a closing mechanism attached at a top portion of the soft-sided sidewall; and a carrying strap coupled to the exterior layer of the soft-sided sidewall.

2. A system to hold a plurality of beverage containers, comprising:

a base of a cooler, the base formed to include a draining geometry that comprises a plurality of draining channels that facilitate movement of water to a draining system;

the draining system at least partially forming a draining hole formed through the base to allow water resting on a top surface of the base to flow through the base;

the draining system including a cap configured to couple to the base in a manner that facilitates an opening of the cap to allow water to drain through the draining hole and a tightening of the cap to restrict water from draining through the draining hole; and a sidewall coupled to the base and formed to have an interior waterproof layer, a middle insulating layer, and an exterior layer.

3. The system of claim 2, wherein the sidewall is a soft-sided sidewall.

4. The system of claim 3, further comprising a beverage sleeve located within an enclosure at least partially formed by the soft-sided sidewall, the beverage sleeve including a 4-way stretch fabric to facilitate holding a beverage container within the beverage sleeve.

5. The system of claim 3, further comprising a closing mechanism attached at a top portion of the soft-sided sidewall.

6. The system of claim 3, further comprising a carrying strap coupled to the exterior layer of the soft-sided sidewall.

7. The system of claim 2, wherein the draining geometry is configured to facilitate a maintaining of an object placed in the cooler above the plurality of draining channels.

8. The system of claim 2, further comprising a dispensing port located at the exterior layer, wherein the dispensing port is connected via a tube to a plug located within an enclosure at least partially formed by the sidewall.

9. The system of claim 8, wherein the sidewall is a soft-sided sidewall, further comprising a beverage sleeve located within the enclosure, the beverage sleeve configured to facilitate holding a beverage container within the beverage sleeve.

10. The system of claim 3, wherein the base has a generally elliptical shape.

11. The system of claim 3, wherein the cap couples at a bottom surface of the base, further wherein the base comprises a plurality of feet that extend downwardly from the bottom surface and maintain the cap above a plane upon which the plurality of feet rest.

12. The system of claim 2, wherein the exterior layer is an interchangeable exterior layer.

13. The system of claim 2, wherein the draining hole is located substantially in the center of the top surface of the base.

14. The system of claim 3, wherein a shape of the top surface of the base is selected from a group consisting of a square shape, a rectangular shape, a triangular shape, a circular shape, and an elliptical shape.

15. A system to hold a plurality of beverage containers, comprising:

a cooler base having a top surface, a bottom surface, and a plurality of feet extending downwardly from the bottom surface;

a draining geometry on the top surface that directs water into a plurality of channels and onto a draining hole formed through the cooler base to allow water resting on the top surface of the cooler base to flow through the cooler base;

a cap configured to couple to the cooler base in a manner that facilitates a loosening of the cap to allow water to drain through the draining hole and a tightening of the cap to restrict water from draining through the draining hole; and a sidewall coupled to the cooler base and formed to have an interior waterproof layer, a middle insulating layer, and an exterior layer.

16. The system of claim 15, wherein the exterior layer is a removable layer.

17. The system of claim 15, wherein the draining hole is formed substantially at the center of the cooler base.

18. The system of claim 15, further comprising a plurality of raised ridges arising from the top surface of the cooler base and at least partially forming the plurality channels.

19. The system of claim 18, wherein the plurality of raised ridges are sized and located to maintain a beverage container placed inside the sidewall from falling to the top surface of the cooler base.

20. The system of claim 15, wherein the sidewall is a soft-sided sidewall.

* * * * *